US011326133B2

(12) United States Patent
Butterick et al.

(10) Patent No.: US 11,326,133 B2
(45) Date of Patent: May 10, 2022

(54) ANTI-REDEPOSITION ADDITIVE FOR LAUNDRY DETERGENT

(71) Applicants: Rohm and Haas Company, Collegeville, PA (US); Union Carbide Corporation, Seadrift, TX (US)

(72) Inventors: Robert Butterick, Swedesboro, NJ (US); Eric Wasserman, Collegeville, PA (US); Afua Sarpong Karikari, Bristol, PA (US)

(73) Assignees: Rohm and Haas Company, Collegeville, PA (US); Union Carbide Corporation, Seadrift, TX (US)

( * ) Notice: Subject to any disclaimer, the term of this patent is extended or adjusted under 35 U.S.C. 154(b) by 0 days.

(21) Appl. No.: 16/975,591

(22) PCT Filed: Mar. 21, 2019

(86) PCT No.: PCT/US2019/023295
§ 371 (c)(1),
(2) Date: Aug. 25, 2020

(87) PCT Pub. No.: WO2019/199423
PCT Pub. Date: Oct. 17, 2019

(65) Prior Publication Data

US 2021/0363471 A1 Nov. 25, 2021

Related U.S. Application Data

(60) Provisional application No. 62/655,269, filed on Apr. 10, 2018.

(51) Int. Cl.

| | |
|---|---|
| ***C11D 11/00*** | (2006.01) |
| ***C11D 3/00*** | (2006.01) |
| ***C11D 3/37*** | (2006.01) |
| ***C11D 1/14*** | (2006.01) |

(52) U.S. Cl.
CPC ..... *C11D 11/0017* (2013.01); *C11D 1/143* (2013.01); *C11D 1/146* (2013.01); *C11D 3/0036* (2013.01); *C11D 3/3757* (2013.01); *C11D 3/3769* (2013.01)

(58) Field of Classification Search
CPC ..... C11D 11/0017; C11D 1/143
See application file for complete search history.

(56) References Cited

U.S. PATENT DOCUMENTS

| | | | | |
|---|---|---|---|---|
| 6,569,976 | B2 * | 5/2003 | Baxter | C08F 220/28 526/317.1 |
| 7,939,601 | B1 | 5/2011 | Bergeron et al. | |
| 8,177,857 | B2 | 5/2012 | Creamer et al. | |
| 10,590,366 | B2 * | 3/2020 | Peera | C11D 3/3765 |
| 2008/0076692 | A1 * | 3/2008 | Carvell | C11D 3/001 510/327 |
| 2008/0262192 | A1 * | 10/2008 | Yoneda | C08F 216/1458 528/332 |
| 2013/0123160 | A1 * | 5/2013 | Dobrawa | C11D 3/3773 510/221 |
| 2015/0307816 | A1 * | 10/2015 | Panandiker | D06M 23/02 510/276 |
| 2016/0281034 | A1 * | 9/2016 | Panandiker | C11D 1/83 |
| 2017/0253834 | A1 * | 9/2017 | Si | C11D 11/0017 |
| 2018/0265825 | A1 * | 9/2018 | Park | C11D 1/94 |
| 2019/0270064 | A1 * | 9/2019 | Postma | C08G 18/6484 |
| 2021/0363471 | A1 * | 11/2021 | Butterick | C11D 3/0036 |

FOREIGN PATENT DOCUMENTS

| | | | |
|---|---|---|---|
| GB | 2104091 | 3/1983 | |
| WO | 0071658 | 11/2000 | |
| WO | WO-0071658 A1 * | 11/2000 | C11D 3/30 |
| WO | 2006064940 | 6/2006 | |
| WO | 2007089001 | 8/2007 | |
| WO | 2008034674 | 3/2008 | |

OTHER PUBLICATIONS

Sibilia, "A Guide to Materials Characterization and Chemical Analysis", 1988, p. 81-84.

* cited by examiner

*Primary Examiner* — Liam J Heincer
*Assistant Examiner* — M. Reza Asdjodi
(74) *Attorney, Agent, or Firm* — Kenneth Crimaldi

(57) ABSTRACT

A laundry detergent composition comprising an anti-redeposition agent, a surfactant, and optionally a builder, wherein the anti-redeposition agent is a polymer comprising polymerized units of: (a) from 5 to 40 wt % of at least one nitrogen-containing ethylenically unsaturated monomer having at least one pKa value from 6 to 11.5, and (b) from 60 to 95 wt % of at least one ethylenically unsaturated carboxylic acid monomer.

5 Claims, No Drawings

ANTI-REDEPOSITION ADDITIVE FOR LAUNDRY DETERGENT

BACKGROUND

This invention relates generally to a polymer useful as an anti-redeposition additive in a laundry detergent composition.

Conventionally, polymers such as polyacrylic acid and carboxymethyl cellulose have been formulated into laundry detergents in order to prevent soil redeposition onto clothing during the wash process. However, many of these polymers do not exhibit a sufficient effect or they require relatively high dosages in order to meet the demands of today's laundry processes where the environmental trend toward lower water usage has drastically increased the concentration of soils in the wash bath. For example, GB2104091A discloses an amphoteric copolymer for this purpose. However, improved additives would be useful.

STATEMENT OF INVENTION

The present invention is directed to a laundry detergent composition comprising a surfactant, optionally a builder, and a polymer comprising polymerized units of: (a) from 5 to 40 wt % of at least one nitrogen-containing ethylenically unsaturated monomer having at least one pKa value from 6 to 11.5, and (b) from 60 to 95 wt % of at least one ethylenically unsaturated carboxylic acid monomer.

DETAILED DESCRIPTION

All percentages are weight percentages (wt %), and all temperatures are in ° C., unless otherwise indicated. Weight average molecular weights, $M_w$, are measured by gel permeation chromatography (GPC) using polyacrylic acid standards, as is known in the art. The techniques of GPC are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. The molecular weights reported herein are in units of daltons. As used herein the term "(meth)acrylic" refers to acrylic or methacrylic; the term "carbonate" to alkali metal or ammonium salts of carbonate, bicarbonate or sesquicarbonate; the term "and the term "citrate" to alkali metal citrates. Percentages of monomer units in the polymer are percentages of solids weight, i.e., excluding any water present in a polymer emulsion. All references to polymerized carboxylic acid units in the polymers include metal salts of the acid which would be present at pH values near or above the pKa of the carboxylic acid groups. pKa values are measured at 25° C. pKa for an amine refers to the pKa of the protonated amine.

Preferably, an ethylenically unsaturated carboxylic acid monomer is a $C_3$-$C_8$ monoethylenically unsaturated carboxylic acid monomer, preferably $C_3$-$C_4$. Preferably, a carboxylic acid monomer has at least one carboxyl group attached to a carbon of a carbon-carbon double bond. Preferably, carboxylic acid monomers have one or two carboxyl groups, preferably one. Preferably, monoethylenically unsaturated carboxylic acid monomers are (meth)acrylic acids.

Preferably, a nitrogen-containing ethylenically unsaturated monomer has at least one pKa value of at least 6.5, preferably at least 7, preferably at least 7.5, preferably at least 8; preferably no greater than 11, preferably no greater than 10.5. Preferably, a nitrogen-containing ethylenically unsaturated monomer is monoethylenically unsaturated. Preferably, a nitrogen-containing ethylenically unsaturated monomer comprises a substituted or unsubstituted amino group, preferably a tertiary amino group, preferably a tertiary aminoalkyl group, preferably a dialkylamino alkyl group, preferably a di-($C_1$-$C_6$ alkyl)aminoalkyl group, preferably a di-($C_1$-$C_4$ alkyl)aminoalkyl group, preferably a dimethylaminoalkyl or diethylaminoalkyl group, preferably a dimethylaminoalkyl group. Preferably, a tertiary aminoalkyl group comprises from 3 to 20 carbon atoms; preferably at least 4 carbon atoms; preferably no more than 15 carbon atoms, preferably no more than 10, preferably no more than 8. Preferably, a nitrogen-containing ethylenically unsaturated monomer is a substituted aminoalkyl ester or amide of (meth)acrylic acid, preferably a di-($C_1$-$C_4$ alkyl)aminoethyl or di-($C_1$-$C_4$ alkyl)aminopropyl (meth)acrylate or (meth) acrylamide, preferably a di-($C_1$-$C_2$ alkyl)aminoethyl or di-($C_1$-$C_2$ alkyl)aminopropyl ester or amide, preferably 2-(dimethylamino)ethyl methacrylate or N-[3-(dimethylamino) propyl]methacrylamide.

Preferably, the polymer comprises at least 7 wt % polymerized units of at least one nitrogen-containing ethylenically unsaturated monomer, preferably at least 8 wt %; preferably no more than 35 wt %, preferably no more than 30 wt %, preferably no more than 25 wt %, preferably no more than 20 wt %, preferably no more than 15 wt %. Preferably, the polymer comprises at least 65 wt % polymerized units of at least one ethylenically unsaturated carboxylic acid monomer, preferably at least 70 wt %, preferably at least 75 wt %, preferably at least 80 wt %, preferably at least 85 wt %; preferably no more than 93 wt %, preferably no more than 92 wt %.

Preferably, the polymer is substantially free of polymerized units of monomers comprising polymerized alkylene oxide units, e.g., ethylene oxide or propylene oxide. Preferably, the polymer is substantially free of polymerized units of any monomers other than monomers (a) and (b) as indicated above. Preferably, the term "substantially free" means having no more than 5 wt %, preferably no more than 2 wt %, preferably no more than 1 wt %, preferably no more than 0.5 wt %, preferably no more than 0.1 wt %.

Preferably, the laundry detergent composition comprises from 0.1 to 5 wt % of the polymer, preferably at least 0.3 wt %, preferably at least 0.5 wt %, preferably at least 0.7 wt %, preferably at least 0.9 wt %; preferably no more than 3 wt %, preferably no more than 2 wt %, preferably no more than 1.5 wt %.

Preferably, the laundry detergent composition comprises from 0 to 90 wt % of water; preferably no more than 70 wt %, preferably no more than 40 wt %, preferably no more than 10 wt %, preferably no more than 5 wt %.

Preferably, the laundry detergent composition comprises at least 1.0 wt % of at least one surfactant; preferably at least 2.0 wt %, preferably at least 5.0 wt %; preferably no more than 70 wt %, preferably no more than 50 wt %, preferably no more than 40 wt %.

The detergent compositions of this invention are generally composed of a mixture of surfactants. At least one of the surfactants is an anionic surfactant. The anionic surfactants are preferably sulfates or sulfonates. One preferred anionic surfactant is an alkylbenzenesulfonate salt, represented by the formula $R_b$—$C_6H_4$—$SO_3M$, in which $R_b$ represents a $C_6$-$C_{18}$ alkyl group, preferably linear, $C_6H_4$ represents a benzenediyl group, preferably a 1,4-benzenediyl group, and M represents a sodium, potassium, or ammonium ion. Another preferred anionic surfactant is the salt of the half-ester of an optionally ethoxylated fatty alcohol, of the formula $R_a$—O-$(AO)_nSO_3M$, where $R_a$ represents a $C_6$-$C_{22}$ linear or branched alkyl group, AO represents ethylene oxide, propylene oxide, butylene oxide, or a combination of two or more alkylene oxides arranged randomly or in blocks, n is a number ranging from 0 to 10, and M represents a cation, preferably a sodium, potassium, or ammonium ion.

The detergent may also contain a non-ionic surfactant, preferably a linear alcohol ethoxylate, in which the alcohol is a linear fatty alcohol of 6-22 carbons, and the surfactant contains 2 to 20 molar equivalents of ethylene oxide.

The detergent may also contain a solvent. Among the preferred solvents are 1,2-propylene glycol, glycerol, and ethanol.

The detergent preferably contains a mixture of builders. Among the preferred builders are sodium tripolyphosphate, sodium carbonate, sodium bicarbonate, and zeolites. The detergent may also be substantially free of phosphate salts (preferably less than 1 wt %.

Preferably, a polymer of this invention comprises no more than 0.3 wt % polymerized units of crosslinking monomers, preferably no more than 0.1 wt %, preferably no more than 0.05 wt %, preferably no more than 0.03 wt %, preferably no more than 0.01 wt %. A crosslinking monomer is a multi-ethylenically unsaturated monomer.

Preferably, the amount of polymerized AMPS units (including metal or ammonium salts) in a polymer of this invention is no more than 10 wt %, preferably no more than 5 wt %, preferably no more than 2 wt %, preferably no more than 1 wt %. Preferably, a polymer of this invention contains no more than 8 wt % polymerized units of esters of acrylic or methacrylic acid, preferably no more than 5 wt %, preferably no more than 3 wt %, preferably no more than 1 wt %.

Preferably, the polymer has $M_w$ of at least 5,000, preferably at least 6,000, preferably at least 9,000, preferably at least 10,000, preferably at least 11,000, preferably at least 12,000; preferably no more than 70,000, preferably no more than 50,000, preferably no more than 30,000, preferably no more than 20,000, preferably no more than 15,000.

The polymer may be used in combination with other polymers useful for controlling insoluble deposits in automatic dishwashers, including, e.g, polymers comprising combinations of residues of acrylic acid, methacrylic acid, maleic acid or other diacid monomers, esters of acrylic or methacrylic acid including polyethylene glycol esters, styrene monomers, AMPS and other sulfonated monomers, and substituted acrylamides or methacrylamides.

Preferably, the polymer of this invention is produced by solution polymerization. Preferably, the polymer is a random copolymer. Preferred solvents include 2-propanol, ethanol, water, and mixtures thereof. Preferably, the initiator does not contain phosphorus. Preferably, the polymer contains less than 1 wt % phosphorus, preferably less than 0.5 wt %, preferably less than 0.1 wt %, preferably the polymer contains no phosphorus. Preferably, polymerization is initiated with persulfate and the end group on the polymer is a sulfate or sulfonate. The polymer may be in the form of a water-soluble solution polymer, slurry, dried powder, or granules or other solid forms.

The polymers of the current invention are potentially useful as dispersants for other cleaning and water-treatment applications, including detergents used in automatic dishwashing in household and institutional washers.

EXAMPLES

Materials. The following materials are evaluated in the examples. Composition details are provided in Table 1.

PAA: a homopolymer of acrylic acid, ACUSOL™ 445N dispersant polymer, available from The Dow Chemical Company.

Examples 1-5 (inventive): copolymers of acrylic acid and 2-(dimethylamino)ethyl methacrylate.

Example 6 (comparative): a copolymer of acrylic acid and 2-(dimethylamino)ethyl methacrylate.

Examples 7-9 (inventive): copolymers of acrylic acid and N-[3-(dimethylamino)propyl]methacrylamide.

TABLE 1

| | Composition | | | | |
|---|---|---|---|---|---|
| Polymer | Monomer 1 wt % | Monomer 2 ID | Monomer 1 wt % | Monomer 2 ID | $M_w$ |
| PAA (comp.) | AA | 100 | | | 7800 |
| Example 1 | AA | 95 | DMAEMA | 5 | 20783 |
| Example 2 | AA | 90 | DMAEMA | 10 | 20395 |
| Example 3 | AA | 80 | DMAEMA | 20 | 19921 |
| Example 4 | AA | 60 | DMAEMA | 40 | 19480 |
| Example 5 | AA | 90 | DMAEMA | 10 | 7209 |
| Example 6 (comp.) | AA | 50 | DMAEMA | 50 | 19235 |
| Example 7 | AA | 90 | DMAPMA | 10 | 9569 |
| Example 8 | AA | 90 | DMAPMA | 10 | 18098 |
| Example 9 | AA | 90 | DMAPMA | 10 | 39150 |

AA = acrylic acid,
DMAEMA = 2-(dimethylamino)ethyl methacrylate,
DMAPMA = N-[3-(dimethylamino)propyl]methacrylamide

Polymer Synthesis

Example 1

To a two liter round bottom flask equipped with a mechanical stirrer, heating mantle, thermocouple, condenser, Nitrogen inlet and inlets for the addition of cofeeds, was charged 300 g deionized water. A promoter solution of 3.32 g of 0.15% iron sulfate heptahydrate was prepared and set aside. A kettle additive of 0.63 g sodium metabisulfite dissolved in 10.0 g of deionized water was prepared and set aside. The kettle contents were stirred and heated to 73±1° C. with a nitrogen sweep. At the same time, 380 g of glacial acrylic acid (AA) was added to a graduated cylinder for addition to the kettle. Separately, 20 g of 2-(dimethylamino) ethyl methacrylate (DMAEMA) was added to a syringe for addition to the kettle. An initiator solution of 1.15 g of sodium persulfate dissolved in 50.0 g deionized water was added to a syringe for addition to the kettle. A chain regulator solution of 13.37 g of sodium metabisulfite dissolved in 60.0 g of deionized water was added to a syringe for addition to the kettle.

When the kettle contents reached the reaction temperature of 73° C., the promoter solution and sodium metabisulfite kettle additive charges were added to the kettle. Upon return to reaction temperature, the monomers, initiator, and chain regulator cofeeds were started simultaneously and separately. The chain regulator solution was added over 80 minutes, monomer cofeeds was added over 90 minutes and the initiator cofeed was added over 95 minutes at 73±1° C. Two chaser solutions of 0.53 g of sodium persulfate dissolved in 10.0 g of deionized water were prepared and added to separate syringes. The first chaser solution was added 10 minutes after the completion of the initiator cofeed. The first chaser solution was added to the kettle over 10 minutes, then held for 20 minutes. After this hold was completed, the second chaser solution was added over 10 minutes, then held for an additional 20 minutes.

While cooling the reactor using a stream of air, 175.0 g of 50% sodium hydroxide was added to the kettle via addition funnel at a rate such that the reaction temperature was maintained below 60° C. Hydrogen peroxide (1.2 g of a 35% solution) was added to the kettle as a scavenger. After 10 minutes, 151.3 g of 50% sodium hydroxide was added to the kettle via addition funnel at a rate such that the reaction temperature was maintained below 60° C. Deionized water (60.0 g) was added to the funnel as a final rinse. The contents were then cooled and packaged.

The final product had a solids content of 42.21%, pH of 6.27, viscosity of 1480 cP. Residual AA content was 70 ppmw. The weight- and number-average molecular weights were 20783 and 5583 g/mol, respectively.

Examples 2-6 may be prepared by a person skilled in the art substantially as described above for Example 1, with appropriate modifications to reagents and conditions.

Example 7

To a two liter round bottom flask equipped with a mechanical stirrer, heating mantle, thermocouple, condenser, Nitrogen inlet and inlets for the addition of cofeeds, was charged 300 g deionized water and 3.32 g of 0.15% iron sulfate heptahydrate. A kettle additive of 0.4 g sodium metabisulfite dissolved in 7.0 g of deionized water was prepared and set aside. The kettle contents were stirred and heated to 73±1° C. with a nitrogen sweep. At the same time, 360 g of glacial AA was added to a graduated cylinder for addition to the kettle. Separately, 40 g of N-[3-(dimethylamino)propyl]methacrylamide (DMAPMA) was added to a syringe for addition to the kettle. An initiator solution of 1.25 g of sodium persulfate dissolved in 50.0 g deionized water was added to a syringe for addition to the kettle. A chain regulator solution of 8.6 g of sodium metabisulfite dissolved in 70.0 g of deionized water was added to a syringe for addition to the kettle.

When the kettle contents reached the reaction temperature of 73° C., the sodium metabisulfite kettle additive charge was added to the kettle. Upon return to reaction temperature, the monomers, initiator, and chain regulator cofeeds were started simultaneously and separately. The chain regulator solution was added over 80 minutes, monomer cofeeds was added over 90 minutes and the initiator cofeed was added over 95 minutes at 73±1° C. Two chaser solutions of 0.53 g of sodium persulfate dissolved in 10.0 g of deionized water were prepared and added to separate syringes. The first chaser solution was added 10 minutes after the completion of the initiator cofeed. The first chaser solution was added to the kettle over 5 minutes, then held for 10 minutes. After this hold was completed, the second chaser solution was added over 5 minutes, then held for an additional 10 minutes.

While cooling the reactor using a stream of air, 100 g of 50% sodium hydroxide was added to the kettle via addition funnel at a rate such that the reaction temperature was maintained below 60° C. Hydrogen peroxide (1.0 g of a 35% solution) was added to the kettle as a scavenger. After 10 minutes, 202 g of 50% sodium hydroxide was added to the kettle via addition funnel at a rate such that the reaction temperature was maintained below 60° C. Deionized water (90.0 g) was added to the funnel as a final rinse. The contents were then cooled and packaged.

The final product had a solids content of 41.22%, pH of 6.52, viscosity of 2880 cP. Residual AA content was 23 ppmw. The weight- and number-average molecular weights were 39150 and 8527 g/mol, respectively.

Examples 8 and 9 may be prepared by a person skilled in the art substantially as described above for Example 7, with appropriate modifications to reagents and conditions.

Polymer Molecular Weight. Molecular weight may be measured by gel permeation chromatograph (GPC) using known methodology, for instance with the following typical parameters:

Analytical Parameters:

Instrument: Agilent 1100 HPLC system with isocratic pump, vacuum degasser, variable injection size autosampler, and column heater, or equivalent.

Detector: Agilent 1100 HPLC G1362A Refractive Index detector, or equivalent.

Software: Agilent ChemStation, version B.04.03 with Agilent GPC-Addon version B.01.01.

Column Set: TOSOH Bioscience TSKgel G2500PW×1 7.8 mm ID×30 cm, 7 μm column (P/N 08020) with TOSOH Bioscience TSKgel GMPW×1 7.8 mm ID×30 cm, 13 μm (P/N 08025).

Method Parameters:

Mobile Phase: 20 mM Phosphate buffer in MilliQ HPLC Water, pH~7.0.

Flow Rate: 1.0 ml/minute

Injection volume: 20 μL

Column temperature: 35° C.

Run time: 30 minutes

Standards And Samples:

Standards: Polyacrylic acid, Na salts Mp 216 to Mp 1,100,000. Mp 900 to Mp 1,100,000 standards from American Polymer Standards.

Calibration: Polynomial fit using Agilent GPC-Addon software (Polynomial 4 used).

Injection concentration: 1-2 mg solids/mL 20 mM GPC mobile phase diluent. Used for both standards and samples.

Sample concentration:

Typically, 10 mg sample into 5 mL 20 mM AQGPC mobile phase solution.

Flow Marker: 30 mM phosphate

Solutions Preparation:

Mobile Phase: Mobile Phase: Weigh out 14.52 g sodium phosphate monobasic ($NaH_2PO_4$) and 14.08 g sodium phosphate dibasic ($Na_2HPO_4$). Dissolve into 11 L MilliQ HPLC water, stir to fully dissolve all solids. After dissolution is complete, adjust the solution to pH 7 with 0.5 N sodium hydroxide. This solution is used for mobile phase and sample/standard preparation via a fixed volume repipetor.

Flow Marker: Mix, by weight, equal amounts of solid $Na_2HPO_4$ and $NaH_2PO_4$. Using the well-blended mix, weigh 1.3 grams and dissolve into 1 liter of the 20 mM AQGPC mobile phase mix.

Anti-Redeposition Testing.

A detergent base formulation was prepared using the unit ratios described in Table 2 below.

TABLE 2

| Detergent Base Formulation | | | |
|---|---|---|---|
| Ingredients (in order of addition) | % Active | Amount Added (g) | % in Finished Product |
| Deionized water | 100.0 | 700.0 | 70.0 |
| NACCONOL ® 90G[1] | 91.6 | 131.0 | 12.0 |
| STEOL ® CS-460[2] | 59.4 | 33.7 | 2.0 |
| Propylene glycol | 100.0 | 35.0 | 3.5 |
| Ethanol | 100.0 | 15.0 | 1.5 |
| Deionized water | 100.0 | 85.3 | q.s. 100% |
| Total | | 1000.0 | 100.0 |

[1]Linear alkylbenzenesulfonate, Stepan Co.

[2]Linear fatty alcohol ether sulfate, Stepan Co.

Anti-redeposition (ARD) performance was assessed in a Terg-o-tometer Model 7243ES (6×1 L wells) agitated at 90 cycles per minute. Formulation details and measurement conditions are described in Table 3.

TABLE 3

| | |
|---|---|
| Temperature | 25° C. |
| Water hardness | 300 ppm, Ca/Mg = 2/1 |
| Fabric Types (2 each/pot) | Cotton Terry, Cotton, Polyester:cotton blend (Polycotton), Cotton interlock |
| Wash Time | 60 minutes |
| Rinse Time | 3 minutes |
| Detergent | See Table 2 |
| Detergent Dosage | 0.5 g/L |
| Polymer* | 2.5 g of a 0.2 wt % dilution (1 wt % final in detergent) |
| Anti-redeposition soils | 0.625 g/L Big Oak Clay (sourced locally from southeastern Pennsylvania)<br>2.5 g/L Body Sebum Emulsion (Scientific Services S/D Inc.) |

*All terg-o-tometer runs included a no-polymer control and an ACUSOL ™ 445N dispersant polymer benchmark Individual fabrics were labeled and baseline whiteness indices (WI) were measured on a Hunter ColorQuest XE colorimeter. Detergent, polymer, and soils were added to each terg-o-tometer pot and agitated for approximately 30 seconds in order to ensure a homogenous solution of detergent and polymer and a uniform dispersion of the soils. Fabrics were then added to the wash bath, washed, and rinsed according to the conditions described above. Upon completion of the rinse cycle, fabrics were dried in internally-vented dryers (about 50° C.). Whiteness indices were measured for the fabrics after wash and averaged for the two cloths of each type added per pot. WI values closer to that of the pristine cloth indicate better performance. The performances of the inventive polymers were benchmarked against the performance of PAA. Results are shown in Table 4, Table 5,

TABLE 4

| | Additive | Whiteness Index | | | |
|---|---|---|---|---|---|
| Sample | wt % in detergent | Cotton Terry | Cotton | Polyester-cotton Blend | Cotton Interlock |
| Pristine | n/a | 142.2 | 73.5 | 105.1 | 78.7 |
| Control[a] | 0 | 108.8 | 62.5 | 76.0 | 67.5 |
| PAA[a] | 1 | 119.5 | 64.6 | 82.6 | 72.2 |
| Example 1[b] | 1 | 123.8 | 65.9 | 90.5 | 75.1 |
| Example 2[b] | 1 | 124.6 | 66.9 | 90.1 | 76.6 |
| Example 3[b] | 1 | 127.2 | 71.0 | 90.5 | 79.4 |

[a]comparative example;

[b]inventive example

TABLE 5

| | Additive | Whiteness Index | | | |
|---|---|---|---|---|---|
| Sample | wt % in detergent | Cotton Terry | Cotton | Polyester-cotton Blend | Cotton Interlock |
| Pristine | n/a | 135.3 | 75.5 | 103.9 | 79.9 |
| Control[a] | 0 | 84.3 | 56.0 | 66.5 | 53.7 |
| PAA[a] | 1 | 95.9 | 61.8 | 78.0 | 61.1 |
| Example 2[b] | 1 | 95.2 | 63.8 | 75.7 | 62.3 |
| Example 3[b] | 1 | 100.0 | 62.7 | 77.4 | 63.7 |
| Example 4[b] | 1 | 92.1 | 63.9 | 75.1 | 58.9 |
| Example 6[a] | 1 | 95.7 | 61.7 | 76.4 | 59.9 |

[a]comparative example;

[b]inventive example

TABLE 6

| | Additive | Whiteness Index | | | |
|---|---|---|---|---|---|
| | wt % in detergent | Cotton Terry | Cotton | Polyester-cotton Blend | Cotton Interlock |
| Pristine | n/a | 143.1 | 74.8 | 83.2 | 86.8 |
| Control | 0 | 95.7 | 36.5 | 40.9 | 36.1 |
| PAA[a] | 1 | 111.4 | 48.9 | 52.8 | 52.8 |
| Example 3[b] | 1 | 114.0 | 50.7 | 54.3 | 57.9 |
| Example 4[b] | 1 | 108.6 | 44.7 | 51.0 | 53.9 |
| Example 6[a] | 1 | 112.6 | 49.0 | 51.0 | 53.9 |

[a]comparative example;

[b]inventive example

TABLE 7

| | Additive | Whiteness Index | | | |
|---|---|---|---|---|---|
| Sample | wt % in detergent | Cotton Terry | Cotton | Polyester-cotton Blend | Cotton Interlock |
| Pristine | n/a | 136.9 | 75.9 | 104.0 | 79.7 |
| Control[a] | 0 | 77.3 | 51.8 | 56.6 | 50.7 |
| PAA[a] | 1 | 79.8 | 57.2 | 72.6 | 51.4 |
| Example 7[b] | 1 | 83.5 | 60.1 | 70.4 | 55.1 |
| Example 8[b] | 1 | 90.6 | 59.7 | 69.2 | 56.8 |
| Example 9[b] | 1 | 88.1 | 58.8 | 72.1 | 56.0 |

[a]comparative example;

[b]inventive example

TABLE 8

| Sample | Additive wt % in detergent | Whiteness Index Cotton Terry | Cotton | Polyester-cotton Blend | Cotton Interlock |
|---|---|---|---|---|---|
| Pristine | n/a | 142.9 | 74.0 | 107.0 | 79.0 |
| Control[a] | 0 | 47.8 | 55.7 | 66.7 | 38.7 |
| PAA[a] | 1 | 68.7 | 58.0 | 71.6 | 47.8 |
| Example 5[b] | 1 | 58.4 | 61.0 | 73.8 | 46.2 |

[a]comparative example;
[b]inventive example

The data in Table 4, Table 5, Table 7 and Table 8 show that Examples 1-5 and Examples 7-9 were best able to maintain the original whiteness of a range cloth types as evidenced by the small change in whiteness indices before and after wash when soil is present.

The invention claimed is:

1. A laundry detergent composition comprising an anti-redeposition agent, a surfactant, and optionally a builder, wherein the anti-redeposition agent is a polymer comprising polymerized units of: (a) from 8 to 15 wt % of at least one di-($C_{1-4}$ alkyl)aminoethyl or di-($C_{1-4}$ alkyl)aminopropyl (meth)acrylate or (meth)acrylamide having at least one pKa value from 7 to 11, and (b) from 85 to 92 wt % of at least one (meth) acrylic acid; wherein the polymer has no more than 0.1 wt % of polymerized monomer units of alkylene oxide and wherein the polymer comprises no more than 0.01 wt % of polymerized units of multiethylenically unsaturated monomer.

2. The composition of claim 1 in which the polymer has $M_w$ from 5,000 to 70,000.

3. The composition of claim 2 in which the polymer comprises polymerized units of from 7 to 30 wt % of at least one di-($C_1$-$C_4$ alkyl)aminoethyl or di-($C_1$-$C_4$ alkyl)aminopropyl (meth)acrylate or (meth)acrylamide and from 70 to 93 wt % of at least one (meth)acrylic acid.

4. The composition of claim 3 in which the surfactant comprises at least one anionic surfactant which is a sulfate or sulfonate.

5. The composition of claim 4 in which the di-($C_1$-$C_4$ alkyl)aminoethyl or di-($C_1$-$C_4$ alkyl)aminopropyl (meth) acrylate or (meth)acrylamide is 2-(dimethylamino)ethyl methacrylate or N-[3-(dimethylamino)propyl]methacrylamide.

* * * * *